US009107482B1

(12) United States Patent
Boelter

(10) Patent No.: US 9,107,482 B1
(45) Date of Patent: Aug. 18, 2015

(54) SURVIVAL APPARATUS

(71) Applicant: Richard A. Boelter, Mesa, AZ (US)

(72) Inventor: Richard A. Boelter, Mesa, AZ (US)

( * ) Notice: Subject to any disclaimer, the term of this patent is extended or adjusted under 35 U.S.C. 154(b) by 0 days.

(21) Appl. No.: 13/848,657

(22) Filed: Mar. 21, 2013

(51) Int. Cl.
*A45B 3/00* (2006.01)
*A45B 3/14* (2006.01)
*F41C 27/18* (2006.01)

(52) U.S. Cl.
CPC ... *A45B 3/00* (2013.01); *A45B 3/14* (2013.01); *F41C 27/18* (2013.01)

(58) Field of Classification Search
CPC ..... F41C 27/18; A45B 3/14; A01B 1/00; B26B 11/00
USPC ..... 135/66; 30/123, 296.1, 342, 329, 340; 42/86
See application file for complete search history.

(56) References Cited

U.S. PATENT DOCUMENTS

| | | | | | |
|---|---|---|---|---|---|
| 30,539 | A | * | 10/1860 | McEvoy | 42/86 |
| 873,054 | A | * | 12/1907 | Krull | 42/86 |
| 1,002,115 | A | * | 8/1911 | Barnes | 42/86 |
| 1,237,330 | A | * | 8/1917 | Hammond | 30/296.1 |
| 1,260,021 | A | * | 3/1918 | Otterson | 42/86 |
| 1,283,465 | A | * | 11/1918 | Burton | 42/106 |
| 2,086,422 | A | * | 7/1937 | Klimt | 403/246 |
| 2,333,379 | A | * | 11/1943 | Johnson, Jr. | 42/86 |
| 2,367,212 | A | * | 1/1945 | Haag | 42/86 |
| 2,833,585 | A | * | 5/1958 | Nischan | 294/51 |
| 3,004,362 | A | * | 10/1961 | Day | 43/6 |
| 3,076,280 | A | * | 2/1963 | Bervoets | 42/86 |
| 3,613,283 | A | * | 10/1971 | Mozey, Jr. | 2/86 |
| 3,949,440 | A | | 4/1976 | Guerra | |
| 4,700,420 | A | | 10/1987 | Belanger | |
| 4,958,395 | A | | 9/1990 | Busskohl | |
| 5,063,628 | A | | 11/1991 | Campbell | |
| 5,105,493 | A | | 4/1992 | Lugtenaar | |
| 5,163,242 | A | | 11/1992 | Smith | |
| 5,799,996 | A | | 9/1998 | Fredrickson | |
| 6,357,067 | B1 | | 3/2002 | Jones | |
| 6,655,069 | B2 | * | 12/2003 | Kim | 42/114 |
| 6,671,913 | B2 | | 1/2004 | Wozniak | |
| 6,671,930 | B2 | * | 1/2004 | Lanz | 16/429 |
| 6,711,772 | B2 | | 3/2004 | Grassi | |
| 6,772,778 | B2 | | 8/2004 | Morosini et al. | |
| 7,958,640 | B1 | | 6/2011 | Mandriota | |
| 2011/0239376 | A1 | | 10/2011 | Schmidt | |
| 2013/0312796 | A1 | * | 11/2013 | Dietz | 135/66 |

OTHER PUBLICATIONS

Pat Crawford, The Survival Staff Hiking Stick, "Turn a Hike Into an Adventure", http://www.crawfordknives.com/Survival%20STAFF%20PAGE%201.htm; May 22, 2012.

* cited by examiner

*Primary Examiner* — Noah Chandler Hawk
(74) *Attorney, Agent, or Firm* — Booth Udall Fuller, PLC

(57) ABSTRACT

A survival apparatus is disclosed that both removably couples to an end portion of a staff and with a variety of tools. The survival apparatus includes at least one sleeve formed of a hollow, tubular body for removably receiving therein the end portion of the staff and providing for the quick attachment and detachment of various tools so that a tool is co-axial with the staff. A survival apparatus system is disclosed that includes: a staff; a tool; and a survival apparatus that both removably couples to an end portion of the staff and with the tool. Another survival apparatus system is disclosed that includes: a staff; a locking lug coupled to the staff; and a tool removably coupled to both the locking lug and an end portion of the staff.

14 Claims, 5 Drawing Sheets

SURVIVAL APPARATUS

BACKGROUND

1. Technical Field

This document relates to a survival apparatus.

2. Background

Conventional devices exist for outdoor or survival activities. These devices are often cumbersome to use, often do not provide the flexibility to use different tools, and often are not adaptable to an existing walking stick or staff.

SUMMARY

Aspects of this document relate to a survival apparatus.

These aspects may comprise, and implementations may include, one or more or all of the components set forth in the appended CLAIMS, which are hereby incorporated by reference.

In one aspect, a survival apparatus is disclosed that both removably couples to an end portion of a staff and with a variety of tools. The survival apparatus includes at least one sleeve formed of a hollow, tubular body for removably receiving therein the end portion of the staff and providing for the quick attachment and detachment of various tools so that a tool is co-axial with the staff. The survival apparatus may include ?.

Particular implementations may include one or more or all of the following.

The at least one sleeve may be cylindrical in shape. The at least one sleeve may include two spaced apart sleeves that are separate and distinct from one another. The at least one sleeve may further include at least one hole there through to accommodate at least one fastener to allow for fastening to the staff. The at least one sleeve may have an end cap to prevent the staff from sliding there through.

A stud may be coupled to the at least one sleeve, and a locking lug may be coupled to the stud to provide for the quick attachment and detachment of various tools to the stud adjacent to the end portion of the staff so that a tool is co-axial with the staff. The stud may be a round solid bar or a hollow tube. The locking lug may be a bayonet lug.

A twist-lock member may be coupled to the at least one sleeve and the tool.

A quick-connect coupling assembly may be coupled to the at least one sleeve and the tool.

In another aspect, a survival apparatus system is disclosed. The survival apparatus system may include: a staff; a tool; and a survival apparatus that both removably couples to an end portion of the staff and with the tool. The survival apparatus includes at least one sleeve formed of a hollow, tubular body that removably receives therein the end portion of the staff and provides for the quick attachment and detachment of various tools so that the tool is co-axial with the staff.

Particular implementations may include one or more or all of the following.

A stud may be coupled to the at least one sleeve extending past the end portion of the staff, and a locking lug may be coupled to the stud at a location that places it adjacent the end portion of the staff, providing for the quick attachment and detachment of the tool to the stud adjacent to the end portion of the staff. The stud may be a round solid bar or a hollow tube. The locking lug may be a bayonet lug. The locking lug may be coupled to an intermediate portion of the stud. The tool may be coupled to both the locking lug and the stud.

A twist-lock may be coupled to the at least one sleeve and the tool.

A quick-connect coupling assembly coupled to the at least one sleeve and the tool.

The tool may include a hilt including a guard, a grip, and a pommel at the end of the grip. The guard may define a stud-receiving hole there through and the pommel at the end of the grip may define therein a lug receiver that matches to the locking lug. The lug receiver may include one of a bump, a rib, and a spring-loaded detent member to removably engage and retain the locking lug therein.

In still another aspect, another survival apparatus system is disclosed. The survival apparatus system may include: a staff; a locking lug coupled to the staff at a location that places it adjacent an end portion of the staff, the locking lug providing for the quick attachment and detachment of a tool to the staff adjacent to the end portion of the staff so that the tool is co-axial with the staff; and the tool removably coupled to both the locking lug and the end portion of the staff.

Particular implementations may include one or more or all of the following.

The staff may be a solid bar or a hollow tube.

The locking lug may be a bayonet lug. The locking lug may be coupled to an intermediate portion of the stud.

The tool may include a hilt including a guard, a grip, and a pommel at the end of the grip. The guard may define a stud-receiving hole there through, and the pommel at the end of the grip may define therein a lug receiver that matches to the locking lug. The lug receiver may include one of a bump, a rib, and a spring-loaded detent member to removably engage and retain the locking lug therein.

The foregoing and other aspects, features, and advantages will be apparent to those of ordinary skill in the art from the DESCRIPTION and DRAWINGS, and from the CLAIMS.

BRIEF DESCRIPTION OF DRAWINGS

Implementations will hereinafter be described in conjunction with the appended DRAWINGS (which are not necessarily to scale), where like designations denote like elements, and.

DESCRIPTION

This document features survival apparatus implementations. There are many features of survival apparatus implementations disclosed herein, of which one, a plurality, or all features or steps may be used in any particular implementation.

In the following description, reference is made to the accompanying DRAWINGS which form a part hereof, and which show by way of illustration possible implementations. It is to be understood that other implementations may be utilized, and structural, as well as procedural, changes may be made without departing from the scope of this document. As a matter of convenience, various components will be described using exemplary materials, sizes, shapes, dimensions, and the like. However, this document is not limited to the stated examples and other configurations are possible and within the teachings of the present disclosure.

Structure

There are a variety of survival apparatus implementations that both removably couple or attach to an end of an existing staff and removably couple with a variety of tools. A staff may be made out of wood or some other material and may refer to many different items, such as a walking stick, pole, branch, and the like. Tools may include a fixed blade knife, a barbed spear point for fishing, a saw, and the like; basically any type of tool used in the outdoors or for survival that may be helpful to have on the end of a staff for various applications.

Figure 1:
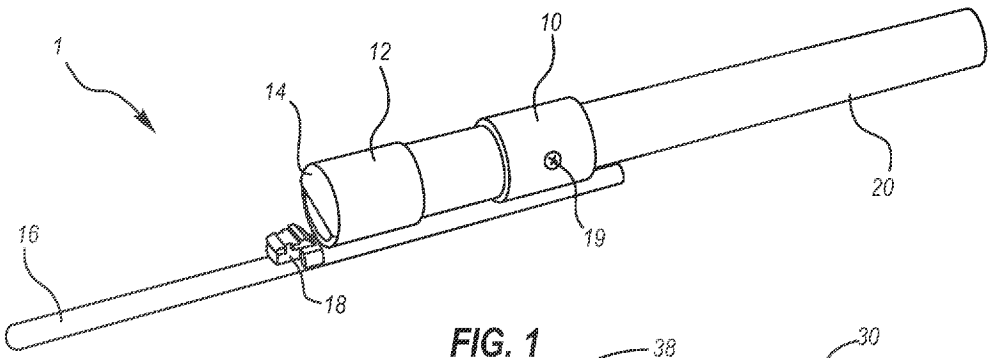
FIG. 1 is a front perspective view of an implementation of a survival apparatus.
Figure 2A:
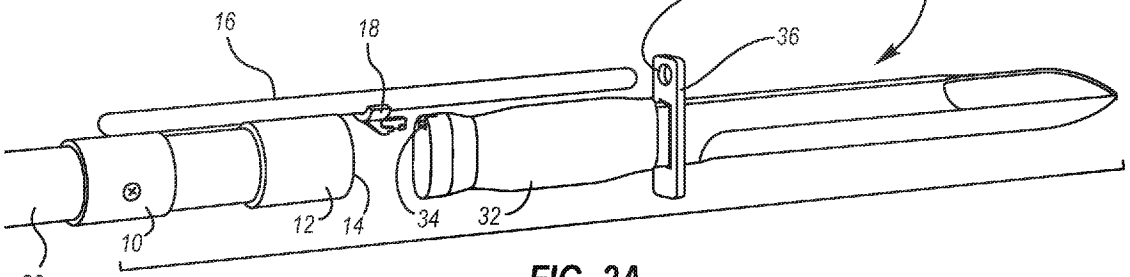
FIG. 2A is an exploded rear perspective view of the survival apparatus of FIG. 1 in combination with a fixed blade knife and a walking staff.
Figure 2B:
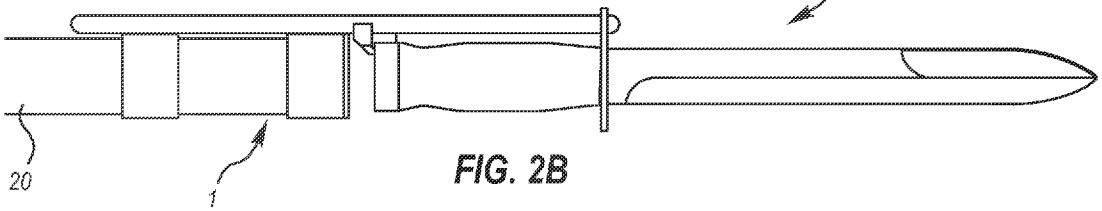
FIG. 2B is a side view of the survival apparatus of FIG. 1 in combination with a fixed blade knife and a walking staff.

Turning to FIGS. 1-2B and for the exemplary purposes of this disclosure, survival apparatus 1 is shown. Survival apparatus 1 generally includes at least one sleeve or band, stud 16, and locking lug 18.

Sleeves or bands 10 and 12 are separate and distinct from one another. They may be in close proximity to each other, or they may be separated by a greater distance depending on the application or the staff 20 involved. Alternatively one elongate sleeve may be employed that would still provide a suitable base or stability for stud 16. Either way, a general hollow, tubular body is formed for removably receiving therein an end portion of a staff 20.

Sleeves or bands 10 or 12 may be cylindrical in shape, or they may have any other suitable curvilinear or rectilinear cross-sectional shape. Sleeves or bands 10 and 12 may each be unitary or comprised of separate pieces. Such separate pieces may be removably coupled together in any manner. Such separate pieces may allow flexibility in accommodating different sizes and shapes of staffs. Thus, sleeves or bands 10 and 12 fit either over or around an end portion of staff 20.

Sleeve 10 may include at least one hole (e.g. could be opposing holes) there through to accommodate at least one fastener 19 (e.g. such as a screw or a pair of screws or a rivet) to allow for fastening to staff 20. Sleeve 12 may have an end cap 14 to prevent staff 20 from sliding there through. End cap 14 may be a full end cap or a partial end cap as depicted.

Stud 16 may be attached to the at least one sleeve and extends past an end of staff 20. Stud 16 may be a round solid bar or hollow tube, or stud 16 may have any other suitable curvilinear or rectilinear cross-sectional shape.

Locking lug 18 may be coupled to stud 16 at a location that places it adjacent the end of staff 20. For example, locking lug 18 may be coupled to an intermediate portion of stud 16. Locking lug 18 may be any device that provides for the quick attachment and detachment of (removably locks or retains) various tools to the stud 16 adjacent to the end of the staff 20 so that the tool is lined up with the staff 20 as though it was an extension of the staff 20; so that the tool is co-axial with the staff 20.

For example, locking lug 18 may be a bayonet lug used for attaching a bayonet to a rifle. A corresponding mechanism would be at the pommel end of the grip of the knife or other attached tool. This mechanism may be a receiving member that matches lug 18. It may also include a bump or rib or a spring-loaded detent member to help engage and retain lug 18 in place.

In describing the operation of survival apparatus 1 in further detail, reference is made to FIGS. 2A-2B where a knife 30 is to be removably attached. Knife 30 may be a fixed-blade knife having a hilt including a guard 36, a grip 32, and a pommel. Guard 36 defines a stud-receiving hole 38. The pommel at the end of grip 32 defines therein a lug receiver 34 that is a matching slot to lug 18.

An end portion of staff 20 may be installed into the pair of sleeves 10 and 12. Fasteners 19 may then be installed in the holes in sleeve 10 to retain apparatus 1 to staff 20. The hilt end of knife 30 may be aligned with the end of staff 20 adjacent stud 16. As knife 30 is then moved coaxially towards the end of staff 20, simultaneously stud hole is engaged with the free end of stud 16 and lug receiver 34 is engaged with lug 18. Knife 30 when attached is lined up with staff 20 as though it was an extension of the staff 20; so that knife 30 is co-axial with staff 20.

Other Implementations

Many additional implementations are possible. Again, though particular knives or other tools are depicted, this disclosure is not limited to those devices as virtually any tool may be employed for use with a staff.

Figure 3A:
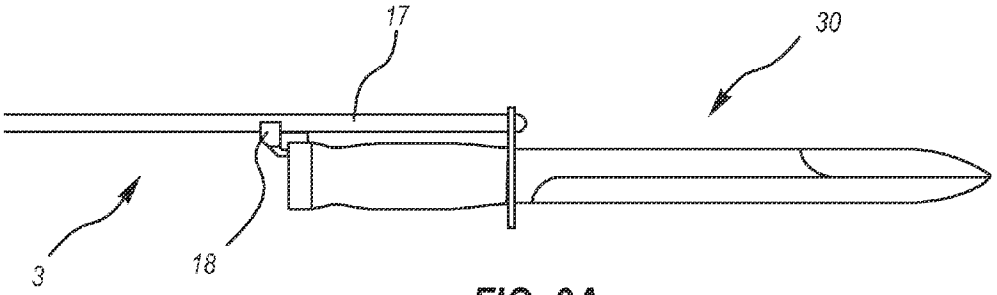
FIGS. 3A-3C are side views of another implementation of a survival apparatus in combination with a fixed blade knife, a barbed spear point, and a saw, respectively.
Figure 3B:
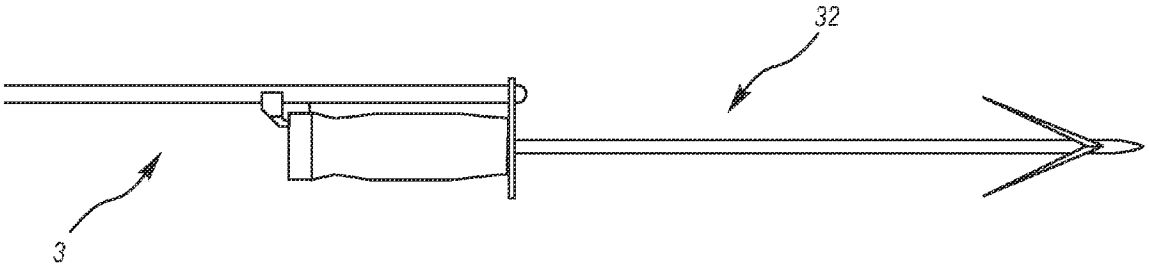
Figure 3C:
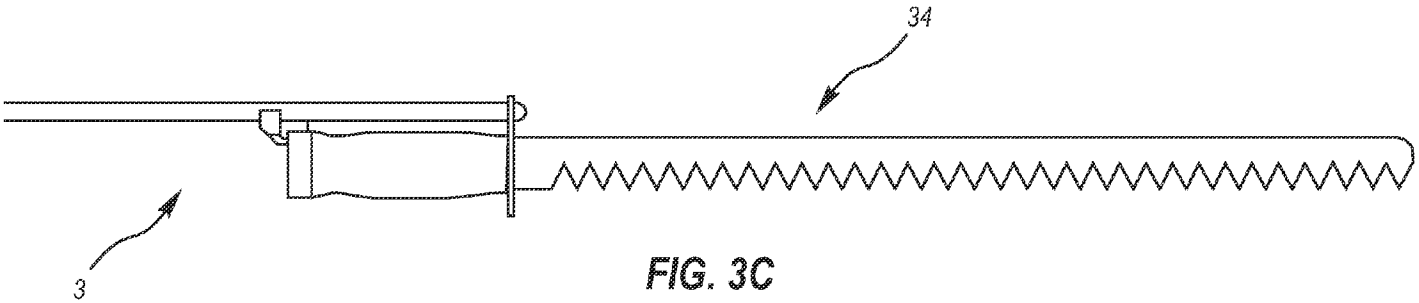

For the exemplary purposes of this disclosure, although there are a variety of survival apparatus implementations, with reference to FIGS. 3A-3B, survival apparatus 3 is shown in use with knife 30, barbed spear point 32, and saw 34. Barbed spear point 32 and saw 34 are similar to knife 30 in that they have a hilt including a guard 36, a grip 32, and a pommel. Guard 36 defines a stud-receiving hole 38. The pommel at the end of grip 32 defines therein a lug receiver 34 that is a matching slot to lug 18.

Survival apparatus 3 is substantially similar to survival apparatus 1 already described. The principal difference is staff 17. Instead of having a separate staff and a separate survival apparatus, they are combined into one. That is, survival apparatus 3 includes a lightweight staff 17 (e.g., fiberglass, carbon fiber, etc. staff) with locking lug 18 coupled or integrally formed at an end portion thereof.

Figure 4A:
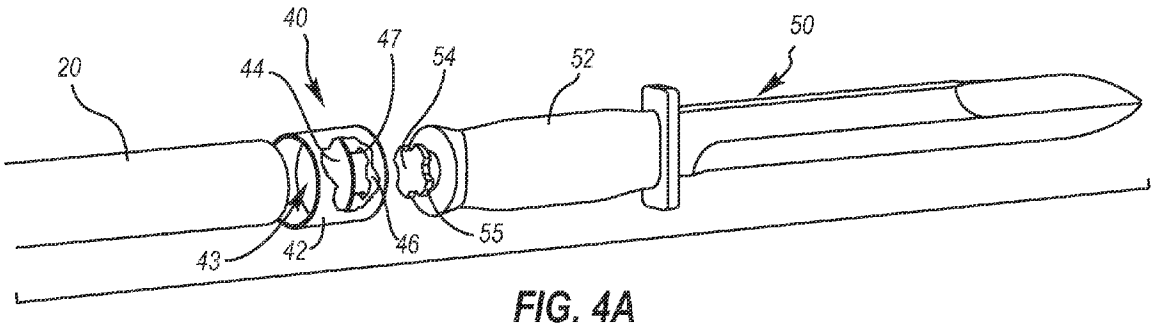
FIGS. 4A-4C are an exploded rear perspective view, a rear perspective view, and a side view, respectively, of still another implementation of a survival apparatus in combination with a fixed blade knife.
Figure 4B:
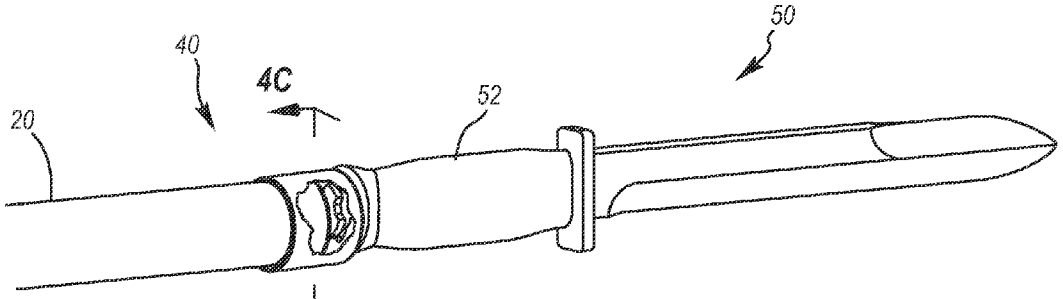
Figure 4C:
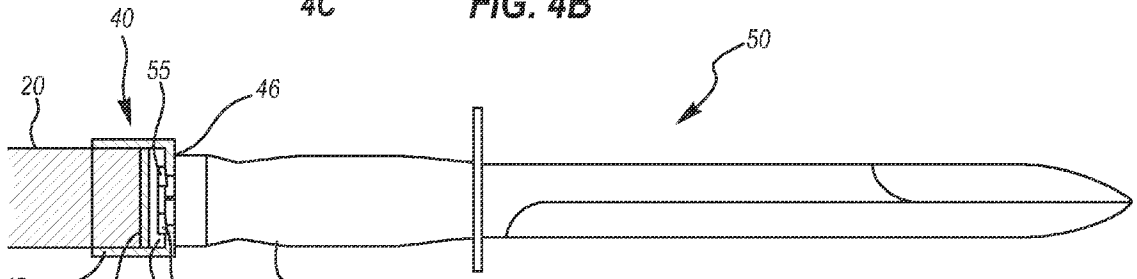

For the exemplary purposes of this disclosure, although there are a variety of survival apparatus implementations, with reference to FIGS. 4A-4C, survival apparatus 40 is shown in use with knife 50. Knife 50 is similar to knife 30 but includes a hilt including a guard, a grip 52, and a pommel 54. Pommel 54 defines a protruding locking lug 55 that matches opening 47 in end cap 42. Locking lug 55 includes a cylindrical base supporting a larger diameter engagement member with at least one orthogonal extension tab. For example, the engagement member may have two orthogonal extension tabs, three orthogonal extension tabs, and the like. As depicted, the engagement member may have 4 orthogonal extension tabs and be in the shape of a cross. The extension tab(s) may be wedge shaped, and the angled surface may even be a gripping or corrugated surface.

Survival apparatus 40 includes an end cap 42. End cap 42 is a sleeve that includes a double end wall (walls 46 and 44 separated by interior space 45) at one end thereof. End wall 44 prevents staff 20 from sliding there through, and end wall 46 defines an opening 47 there through that matches locking lug 55 and opens to interior space 45. Thus, opening 47 may have at least one radial extension. For example, the opening 47 may have two radial extensions, three radial extensions, and the like. As depicted, the opening 47 may have four radial extensions and be in the shape of a cross. The portion(s) of wall 46 defining opening 47 between the radial extension(s) may be wedge shaped, and the angled surface may even be a gripping or corrugated surface. End cap 42 also defines therein an opening 43 at an opposite end thereof configured to removably receive therein an end portion of staff 20 or some other staff.

End cap 42 may be cylindrical in shape, or it may have any other suitable curvilinear or rectilinear cross-sectional shape. End cap 42 may each be unitary or comprised of separate pieces. Such separate pieces may be removably coupled together in any manner. Such separate pieces may allow flexibility in accommodating different sizes and shapes of staffs. Thus, End cap 42 fits either over or around an end portion of staff 20. End cap 42 may include at least one hole (e.g. could be opposing holes) there through to accommodate at least one fastener (e.g. such as a screw or a pair of screws or a rivet) to allow for fastening to staff 20.

In operation, as depicted in FIGS. 4B-4C, an end portion of staff 20 may be installed into opening 43. If not a friction fit or some other type of fitting, then fasteners may be installed in holes in end cap 42 to retain apparatus 40 to an end of staff 20. The hilt end of knife 50 may be aligned with the end of staff 20 adjacent end cap 42 so that the radial extension(s) of opening 47 align with the orthogonal extension tabs of locking lug 55. As knife 50 is then moved coaxially towards the end of staff 20, locking lug 55 passes through opening 47 into interior space 45. Then, either the staff 20 or knife 50 may be twisted or rotated while holding the other one stationary forcing the orthogonal extension tabs to engage with one another in a friction fit arrangement. As the respective angled surfaces of the extension tab(s) of locking lug 55 and the portion(s) of wall 46 between the radial extension(s) engage with one another, the locking lug 55 is forced further into interior space 45 and engages with end wall 44 until rotation can no longer be achieved. Knife 50 when attached is lined up with staff 20 as though it was an extension of the staff 20; so that knife 50 is co-axial with staff 20.

Figure 5A:
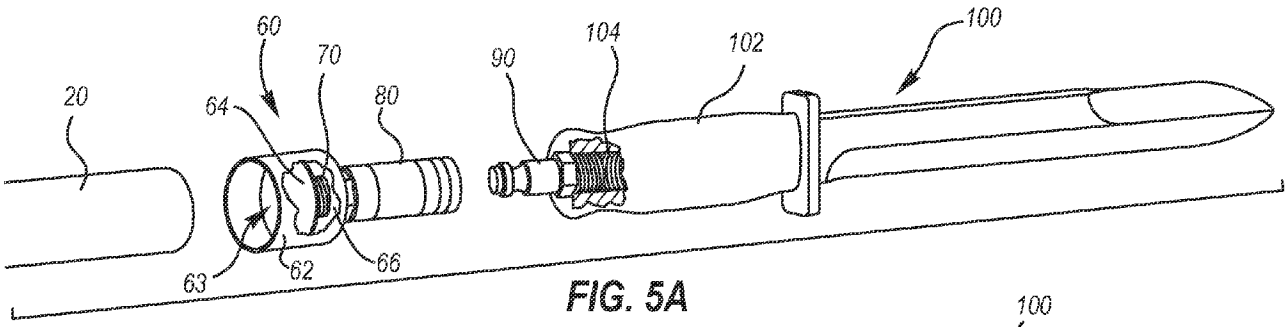
FIGS. 5A-5C are each an exploded rear perspective view of yet another implementation of a survival apparatus in combination with a fixed blade knife.

For the exemplary purposes of this disclosure, although there are a variety of survival apparatus implementations, with reference to FIG. 5A, another survival apparatus is shown in use with knife 100. Knife 100 is similar to knives 30 and 50 but includes a hilt including a guard, a grip 102, and a pommel. The pommel defines threaded recess 104 therein that is a matching threaded recess to a threaded end of a male coupler plug 90.

In this survival apparatus implementation, knife 100 may be removably coupled to staff 20 via a quick connect coupling assembly 60. In general, quick connect coupling assembly 60 operates by pulling back on an outside sleeve that is part of an internal wedge inside a socket. This outside sleeve moves the internal wedge that is pushing against a series of ball bearings retaining a male component therein. Once the wedge moves and allows the ball bearings to move, the male component can either be inserted or removed. The male component cannot be inserted into the socket to connect a tool unless the sleeve is in its refracted position. Similarly, the components cannot be disconnected unless the sleeve is moved from its locking to its retracted position.

Specifically, quick connect coupling assembly 60 includes an end cap 62. End cap 62 is a sleeve that includes a double end wall (walls 66 and 64 separated by interior space) at one end thereof. End wall 64 prevents staff 20 from sliding there through, and end wall 66 defines a threaded opening there through. End cap 62 also defines therein an opening 63 at an opposite end thereof configured to removably receive therein an end portion of staff 20 or some other staff.

End cap 62 may be cylindrical in shape, or it may have any other suitable curvilinear or rectilinear cross-sectional shape. End cap 62 may each be unitary or comprised of separate pieces. Such separate pieces may be removably coupled together in any manner. Such separate pieces may allow flexibility in accommodating different sizes and shapes of staffs. Thus, end cap 62 fits either over or around an end portion of staff 20. End cap 62 may include at least one hole (e.g. could be opposing holes) there through to accommodate at least one fastener (e.g. such as a screw or a pair of screws or a rivet) to allow for fastening to staff 20.

Quick connect coupling assembly 60 also includes a nipple 70. Nipple 70 is a short fitting, including a male thread at each end, for connecting two other fittings. It may have a hexagonal section in the center for wrench to grasp (sometimes referred to as a "hex nipple"), or it may simply be made from a short piece of pipe (sometimes referred to as a "barrel nipple"). It may also be a "close nipple" with no unthreaded area; when screwed tightly between two female fittings, very little of the nipple remains exposed. Or its ends may be of two different sizes and it may be a "reducer" or "unequal nipple". At any rate, nipple 70 removably threads at one end into the threaded opening defined through end wall 66 and removably threads at the opposite end into a threaded opening defined in an end of quick coupler 80.

Quick coupler 80 is essentially a socket assembly with a slidable locking sleeve. Specifically, the socket assembly comprises a threaded opening defined in an end of thereof for receiving an end of nipple 70 and a socket member defining therein a generally cylindrical chamber for receiving a plug end of a male coupler 90. A sleeve is provided for holding the plug end of male coupler 90 captive in the chamber. The sleeve is slidably mounted on the socket member to move axially with respect to the socket member from a refracted position in which the plug end of male coupler 90 may be inserted into the chamber, to a locking position in which the plug end of male coupler 90 is held captive in the socket member, and then back to a retracted position in which the plug end of male coupler 90 may be removed from the socket member. A spring disposed between the sleeve and the outlet end of the socket member biases the sleeve to move toward its locking position. A plurality of detent balls or bearings are mounted in holes spaced at intervals around the circular wall of the socket chamber adjacent the outlet end of the socket member. These balls are free to move radially with respect to the socket member between a radially inward position in which they are adapted to be received in a circumferential groove in the plug end of male coupler 90 to hold the plug end of male coupler 90 captive in the socket chamber, and a radially outward position in which they are removed from the groove. When sleeve is moved to its refracted position against the bias of spring, the plug end of male coupler 90 may be inserted into the socket chamber. As the plug end of male coupler 90 moves into the chamber, an annular flange on the plug end of male coupler 90 engages the detent balls and forces them toward their stated radially outward position, thereby allowing the nipple to be fully inserted into the socket chamber. The sleeve may then be allowed to return to its locking position (under the urging of the spring) in which balls are forced radially inwardly by the inside surface of the sleeve into the groove for holding the plug end of male coupler 90 captive in the socket chamber.

Male coupler plug 90 includes a threaded end and an opposing plug end as previously described. It may have a hexagonal section in the center for wrench to grasp. The threaded end removably threads into threaded recess 104 and the plug end removably couples with the quick coupler 80 as previously described.

Alternatively, instead have having a female quick coupler 80 as previously described, a male quick coupler may be employed and nipple 70 eliminated, thereby reducing the number of components.

Figure 5B:
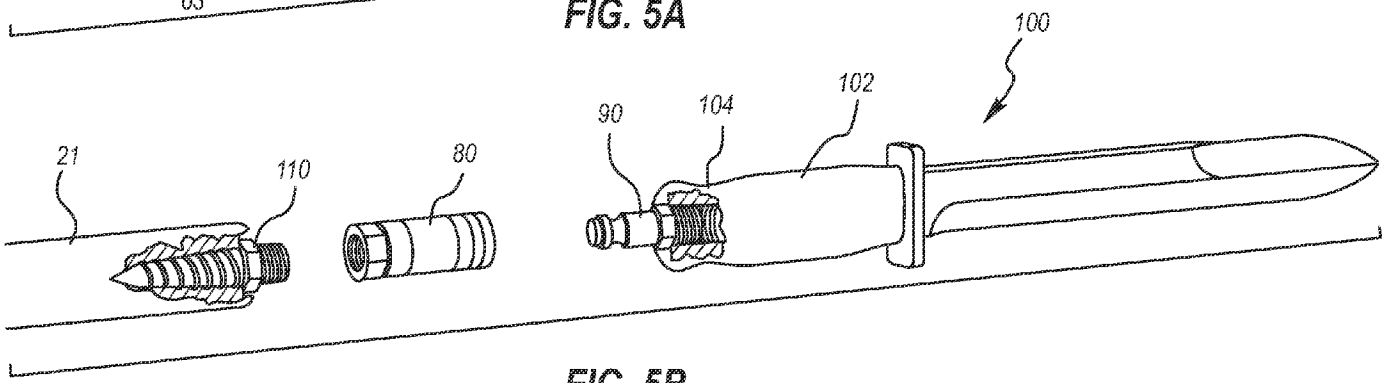

For the exemplary purposes of this disclosure, although there are a variety of survival apparatus implementations, with reference to FIG. 5B, another survival apparatus is shown in use with knife 100. This survival apparatus is substantially similar to survival apparatus previously described. The principal differences are staff 21 and nipple 110, as it includes coupler plug 90 and quick coupler 80.

Staff 21 may have a threaded recess in an end thereof or not depending on nipple 110. If nipple 110 is self-tapping, then it does not, or possibly could have a small pilot hole to facilitate nipple 110 coupling to the end of staff 21. Nipple 110 includes a male thread at each end, for connecting to staff 21 and quick coupler 80, respectively. Its ends may be of two different sizes and or lengths and it may be an "unequal nipple". It may have a hexagonal section in the center for wrench to grasp. At any rate, nipple 110 removably threads at one end into staff 21 and removably threads at the opposite end into a threaded opening defined in an end of quick coupler 80.

Alternatively, instead have having a female quick coupler 80 as previously described, a male quick coupler may be employed and nipple 110 eliminated if staff 21 has a corresponding threaded recess in an end thereof, thereby reducing the number of components.

Figure 5C:
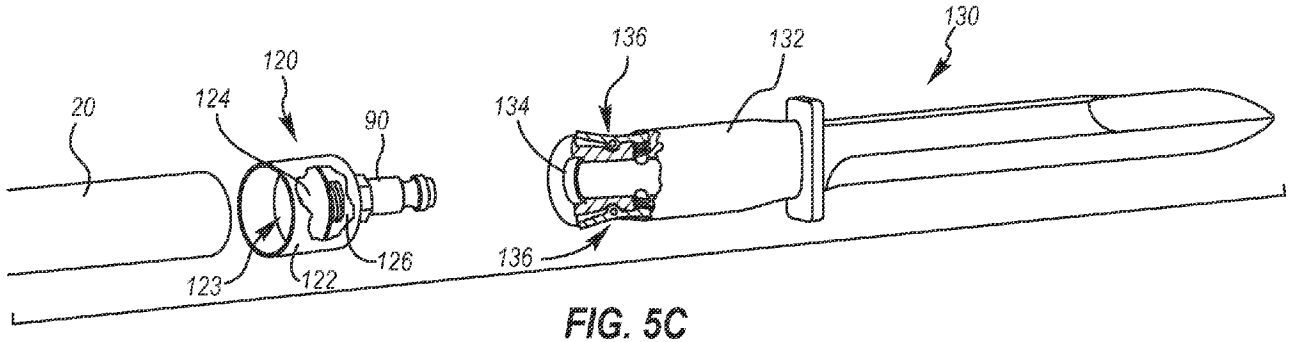

For the exemplary purposes of this disclosure, although there are a variety of survival apparatus implementations, with reference to FIG. 5C, another survival apparatus is shown in use with knife 130. Knife 130 is similar to knife 100 but includes a hilt including a guard, a grip 132, and a pommel. The pommel defines countersunk recess 134 therein that is a matching recess to a plug end of male coupler plug 90. When installed together, makes for a very clean attachment, close to the end of staff 20. Installed flush with the surface of grip 132 are opposing detent assemblies 136.

This survival apparatus is substantially similar to the two survival apparatuses previously described. The principal difference is quick connect coupling assembly 120. Knife 130 may be removably coupled to staff 20 via quick connect coupling assembly 120.

Specifically, quick connect coupling assembly 120 includes an end cap 122. End cap 122 is a sleeve that includes a double end wall (walls 126 and 124 separated by interior space) at one end thereof. End wall 124 prevents staff 20 from sliding there through, and end wall 126 defines a threaded opening there through. End cap 122 also defines therein an opening 123 at an opposite end thereof configured to removably receive therein an end portion of staff 20 or some other staff.

End cap 122 may be cylindrical in shape, or it may have any other suitable curvilinear or rectilinear cross-sectional shape. End cap 122 may each be unitary or comprised of separate pieces. Such separate pieces may be removably coupled together in any manner. Such separate pieces may allow flexibility in accommodating different sizes and shapes of staffs. Thus, end cap 122 fits either over or around an end portion of staff 20. End cap 122 may include at least one hole (e.g. could be opposing holes) there through to accommodate at least one fastener (e.g. such as a screw or a pair of screws or a rivet) to allow for fastening to staff 20.

Male coupler plug 90 includes a threaded end and an opposing plug end as previously described. It may have a hexagonal section in the center for wrench to grasp. The threaded end removably threads into the threaded recess of end wall 126 and the plug end removably couples with the pommel end of knife 130.

The pommel end of knife 130 is similar in function as quick coupler 80. The pommel end of knife 130 is essentially a socket assembly. As depicted, installed flush with the surface of grip 132 are opposing detent assemblies 136. Alternatively, a slidable locking sleeve could be employed. Specifically, the socket assembly comprises a socket member defining therein a generally cylindrical chamber 134 for receiving a plug end of a male coupler 90. Opposing detent assemblies 136 are provided for holding the plug end of male coupler 90 captive in the chamber. The opposing detent assemblies 136 are mounted to pivot with respect to the socket member from a retracted position in which the plug end of male coupler 90 may be inserted into the chamber, to a locking position in which the plug end of male coupler 90 is held captive in the socket member, and then back to a retracted position in which the plug end of male coupler 90 may be removed from the socket member. Springs bias opposing detent assemblies 136 in their locking positions. Detent balls or bearings are mounted in holes spaced at intervals around the circular wall of the socket chamber adjacent the outlet end of the socket member. These balls are free to move radially with respect to the socket member between a radially inward position in which they are adapted to be received in a circumferential groove in the plug end of male coupler 90 to hold the plug end of male coupler 90 captive in the socket chamber, and a radially outward position in which they are removed from the groove.

For the exemplary purposes of this disclosure, although there are a variety of survival apparatus implementations, another survival apparatus may include a quick coupler integrally formed with or coupled to the end of a staff, and a knife or other tool having an end defining or formed in the shape of a plug end of a male coupler plug.

Figure 6:
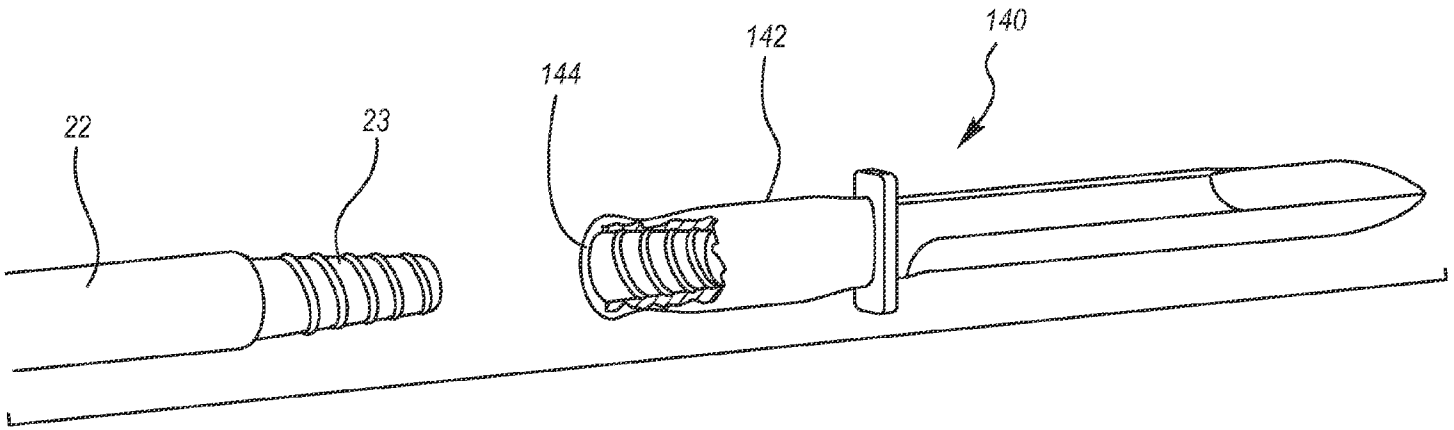
FIG. 6 is an exploded rear perspective view of even another implementation of a survival apparatus in combination with a fixed blade knife.

For the exemplary purposes of this disclosure, although there are a variety of survival apparatus implementations, with reference to FIG. 6, another survival apparatus is shown in use with knife 140. Knife 140 is similar to knife 100 but includes a hilt including a guard, a grip 142, and a pommel. The pommel defines threaded recess 144 therein that is a matching threaded recess to threaded male end 23 of staff 22.

For the exemplary purposes of this disclosure, as set forth earlier, there are many features of survival apparatus implementations disclosed herein, of which one, a plurality, or all features or steps may be used in any particular implementation. For example, to increase the strength of the connection of a staff to a tool/knife, the stud 16 and a second band/sleeve 10 may be employed with any of the other survival apparatus implementations discussed above, such as those set forth in FIGS. 4-6 for example. Stud 16 and band/sleeve 10 would help to provide stiffness and strength between the tool and the staff. Such a configuration of components will prevent any rotation of the tool/knife and greatly increase the stiffness/strength of the connection.

For the exemplary purposes of this disclosure, where a rotation may be necessary to lock in a tool to a survival apparatus implementation, such as in the survival apparatus implementation of FIG. 4A-4C, the rotation could alternatively occur at the apparatus versus rotating the knife. For example, a rotating ring could be employed at the end of the cap that would rotate a set of locking lugs to lock in the fixed lugs at the pommel end of the tool/knife. As another option, a detent could be included so that once the rotation was to a certain position, there would be a physical click or indication that it was locked in place.

For the exemplary purposes of this disclosure, end cap 42 may be split longitudinally and provided with a slip-tightening ring so that any portion of the hilt end of a tool may be releasably secured over the end of a staff.

Further implementations are within the CLAIMS

Specifications, Materials, Manufacture, Assembly

It will be understood that implementations are not limited to the specific components disclosed herein, as virtually any components consistent with the intended operation of a survival apparatus implementation may be utilized. Accordingly, for example, although particular components and so forth, are disclosed, such components may comprise any shape, size, style, type, model, version, class, grade, measurement, concentration, material, weight, quantity, and/or the like consistent with the intended operation of a survival apparatus implementation. Implementations are not limited to uses of any specific components, provided that the components selected are consistent with the intended operation of a survival apparatus implementation.

Accordingly, the components defining any survival apparatus implementation may be formed of any of many different types of materials or combinations thereof that can readily be formed into shaped objects provided that the components selected are consistent with the intended operation of a survival apparatus implementation. For example, the components may be formed of: woods, wood composites, and/or other like materials, such as MDF; rubbers (synthetic and/or natural) and/or other like materials; glasses (such as fiberglass), carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, spring steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Various survival apparatus implementations may be manufactured using conventional procedures as added to and improved upon through the procedures described here. Some components defining survival apparatus implementations may be manufactured simultaneously and integrally joined with one another, while other components may be purchased pre-manufactured or manufactured separately and then assembled with the integral components.

For example, many of the components of various implementations may be off the shelf products, such as many of the components of quick connect coupling assembly implementations that would typically be used in other fields or applications.

Manufacture of these components separately or simultaneously may involve extrusion, pultrusion, vacuum forming, injection molding, blow molding, resin transfer molding, casting, forging, cold rolling, milling, drilling, routing, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components.

It will be understood that the assembly of survival apparatus implementations are not limited to the specific order of steps as disclosed in this document. Any steps or sequence of steps of the assembly of survival apparatus implementations indicated herein are given as examples of possible steps or sequence of steps and not as limitations, since various assembly processes and sequences of steps may be used to assemble survival apparatus implementations.

Use

Implementations of a survival apparatus are particularly useful in outdoor or survival applications. However, implementations are not limited to these applications. Rather, any description relating to these applications is for the exemplary purposes of this disclosure, and implementations may also be used in a variety of other applications with similar results.

In places where the description above refers to particular implementations, it should be readily apparent that a number of modifications may be made without departing from the spirit thereof and that these implementations may be alternatively applied. The accompanying CLAIMS are intended to cover such modifications as would fall within the true spirit and scope of the disclosure set forth in this document. The presently disclosed implementations are, therefore, to be considered in all respects as illustrative and not restrictive, the scope of the disclosure being indicated by the appended CLAIMS rather than the foregoing DESCRIPTION. All changes that come within the meaning of and range of equivalency of the CLAIMS are intended to be embraced therein.

The invention claimed is:

1. A survival apparatus that both removably couples to an end portion of a staff and with a variety of tools, the survival apparatus comprising:

two spaced apart sleeves that are separate and distinct from one another each sleeve formed of a hollow, tubular body for removably receiving therein the end portion of the staff and providing for the quick attachment and detachment of various tools so that a tool is co-axial with the staff;

a stud having a portion thereof coupled to the two spaced apart sleeves and a free portion thereof extending away from the sleeves; and a locking lug coupled to the free end portion of the stud and providing for the quick attachment and detachment of various tools to the stud adjacent to the end portion of the staff so that a tool is co-axial with the staff.

2. The survival apparatus of claim 1 wherein the sleeves are cylindrical in shape.

3. The survival apparatus of claim 1 wherein one sleeve further comprises at least one hole there through to accommodate at least one fastener to allow for fastening to the staff.

4. The survival apparatus of claim 1 wherein one sleeve has an end cap to prevent the staff from sliding there through.

5. The survival apparatus of claim 1 wherein the stud is a round solid bar, and wherein the locking lug is a bayonet lug.

6. A survival apparatus system comprising:

a staff;

a tool comprising a hilt including a guard, a grip, and a pommel at the end of the grip, wherein the guard defines a stud-receiving hole there through, and wherein the pommel at the end of the grip defines therein a lug receiver that matches to a locking lug such that the tool removably couples to both the locking lug and a stud;

a survival apparatus that both removably couples to an end portion of the staff and with the tool, the survival apparatus comprising at least one sleeve formed of a hollow, tubular body that removably receives therein the end portion of the staff and provides for the quick attachment and detachment of various tools so that the tool is co-axial with the staff; and the stud coupled to the at least one sleeve and extending past the end portion of the staff, and the locking lug coupled to the stud at a location that places it adjacent the end portion of the staff, the locking lug providing for the quick attachment and detachment of the tool to the stud adjacent to the end portion of the staff.

7. The survival apparatus system of claim 6 wherein the locking lug is coupled to an intermediate portion of the stud.

8. The survival apparatus system of claim 6 wherein the locking lug is a bayonet lug.

9. The survival apparatus system of claim 6 wherein the lug receiver includes one of a bump, a rib, and a spring-loaded detent member to removably engage and retain the locking lug therein.

10. A survival apparatus system comprising:

a staff;

a locking lug coupled to the staff at a location that places it adjacent an end portion of the staff, the locking lug providing for the quick attachment and detachment of a tool to the staff adjacent to the end portion of the staff so that the tool is co-axial with the staff; and the tool removably coupled to both the locking lug and the end portion of the staff, the tool comprising a hilt including a guard, a grip, and a pommel at the end of the grip, wherein the guard defines a stud-receiving hole there through, and wherein the pommel at the end of the grip defines therein a lug receiver that matches to the locking lug.

11. The survival apparatus system of claim 10 wherein the staff is one of a solid bar and a hollow tube.

12. The survival apparatus of claim 10 wherein the locking lug is a bayonet lug.

13. The survival apparatus system of claim 10 wherein the locking lug is coupled to an intermediate portion of the stud.

14. The survival apparatus system of claim 10 wherein the lug receiver includes one of a bump, a rib, and a spring-loaded detent member to removably engage and retain the locking lug therein.

* * * * *